US006958439B1

(12) United States Patent
White

(10) Patent No.: US 6,958,439 B1
(45) Date of Patent: Oct. 25, 2005

(54) DOBRO CAPO

(76) Inventor: Kenneth G. White, 530 Minnesota St., Lebanon, OR (US) 97355

( * ) Notice: Subject to any disclaimer, the term of this patent is extended or adjusted under 35 U.S.C. 154(b) by 0 days.

(21) Appl. No.: 10/793,724

(22) Filed: Mar. 4, 2004

(51) Int. Cl.[7] ..... G10D 3/00
(52) U.S. Cl. ..... 84/318; 84/319; 84/315
(58) Field of Search ..... 84/318, 319, 315

(56) References Cited

U.S. PATENT DOCUMENTS 468,193 A * 2/1892 Dahlman et al. ..... 84/318
4,270,432 A * 6/1981 Wilkerson ..... 84/318
4,671,156 A 6/1987 Hathcock
5,284,077 A 2/1994 Ellis
6,521,820 B1 * 2/2003 Patel ..... 84/318

* cited by examiner

*Primary Examiner*—Shih-Yung Hsieh
(74) *Attorney, Agent, or Firm*—Robert E. Howard

(57) ABSTRACT

A capo for use with a dobro or similar stringed instrument. The capo includes upper and lower curved bar members, each bar member having a horizontal arm portion and a downwardly curved arm portion meeting at a juncture. The upper and lower curved bar members are pivotally attached to each other adjacent the junctures of their horizontal and downwardly curved arm portions. A slot extends longitudinally in the mid-portion of the downwardly curved arm portion of the upper curved bar member, and a cam locking lever is pivotally mounted within the slot. A string hold down bar is pivotally mounted to the outer end of the horizontal arm portion of the upper curved bar member.

7 Claims, 3 Drawing Sheets

DOBRO CAPO

BACKGROUND OF THE INVENTION

The present invention relates to a capo device for varying the resonant length of tensioned strings on a stringed musical instrument, such as a dobro.

A dobro is similar in appearance to a guitar, and includes a hollow body portion with a metallic acoustic panel, an elongated neck which terminates in a tuning head, and six tensioned strings. However, dobro strings are formed of a heavier gauge wire than the strings of a guitar and are substantially less flexible. In addition, the strings of a dobro are positioned well above the fretboard on the neck of the dobro so that the distance between the dobro string and the fretboard is much greater on a dobro than on a guitar. In addition, the neck of the dobro is wider than the neck of a guitar. A dobro is held in a generally flat position across the lap of the player so that the neck and strings are horizontal, approximately perpendicular to the player's body.

Unlike a guitar player, a dobro player does not finger the strings to form a desired chord, but dampens or compresses the strings with a bar at the selected position across a fret with one hand while strumming or plucking the strings with the other hand.

Capos are sometimes used with guitars. A "capo" is a device that shortens the strings uniformly to facilitate a change of key from the major chord to which the guitar is initially tuned at the tuning head. For a number of reasons, including the difference in strings, height of the strings above the fretboard, and the wider neck of the dobro, capos used with guitars are not useful with dobros.

There have been some suggestions in the prior art for capo designs to be used with dobros. However, prior art capos suggested for use with dobros are generally difficult to quickly change with one hand while playing.

SUMMARY OF THE PRESENT INVENTION

It is an object of the present invention to provide a dobro capo that is easy to use with one hand.

The capo includes upper and lower curved bar members, each bar member having a horizontal arm portion and a downwardly curved arm portion meeting at a juncture. Preferably the downwardly curved arms of said upper and lower curved bar members curve downwardly at an angle to the horizontal.

The upper and lower curved bar members are pivotally attached to each other adjacent the junctures of their horizontal and downwardly curved arm portions. A slot extends longitudinally in the mid-portion of the downwardly curved arm portion of the upper curved bar member, and a cam locking lever is pivotally mounted within the slot. A string hold down bar is pivotally mounted to the outer end of the horizontal arm portion of the upper curved bar member

DESCRIPTION OF PREFERRED EMBODIMENTS

Figure 1:
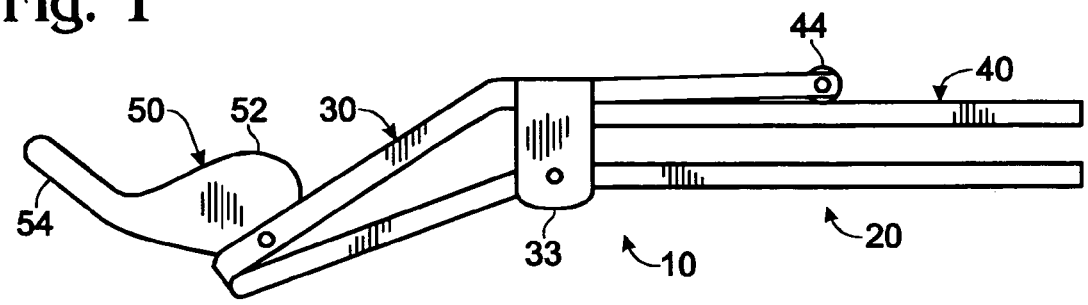
FIG. 1 is a right side elevational view of the dobro capo of the present invention, shown in its open position.

The dobro capo 10 of the present invention includes a lower curved bar member 20, an upper curved bar member 30, a pivoting string hold down bar 40, and a cam locking lever 50.

Figure 3:
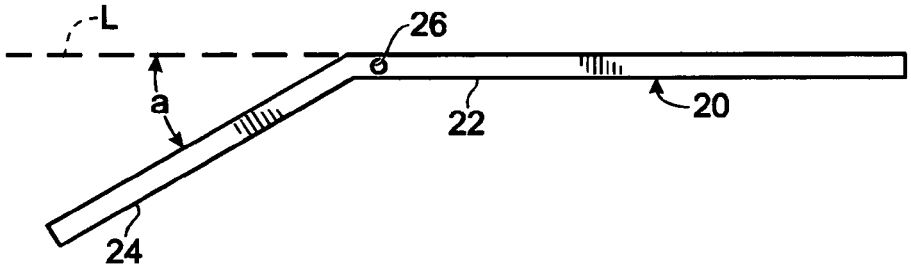
FIG. 3 is a right side elevational view of the lower curved bar member of the dobro capo.

Lower curved bar member 20 includes a horizontal arm portion 22 and a downwardly curved arm portion 24 that meet at a juncture. Downwardly curved arm portion 24 is at an angle "a" (FIG. 3) of between about 20 degrees and about 30 degrees, preferably about 25 degrees, to the horizontal line "L" extended from horizontal arm portion 22.

Figure 4:
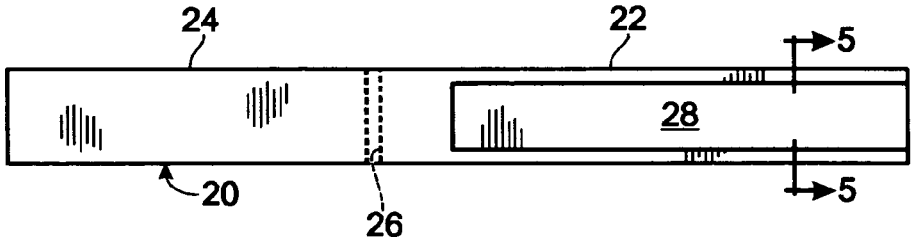
FIG. 4 is a top plan view of the lower curved bar member of the dobro capo.
Figure 5:
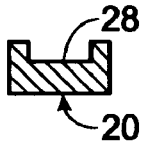
FIG. 5 is a front elevational view of the lower curved bar member of the DOBRO capo, taken along line 5—5 of FIG. 4.

A pivot pin opening 26 is located just forward of the juncture of horizontal arm portion 22 and downwardly curved arm portion 24 of lower curved bar member 20. The bottom or lower side of lower curved bar member 20, as seen in FIG. 4, has a groove 28 formed in the horizontal arm portion 22 which is located in the mid-portion of horizontal arm portion 22 and extends longitudinally from in front of pivot pin opening 26 to the outer end of the horizontal arm portion 22 of lower curved bar member 20.

Figure 2:
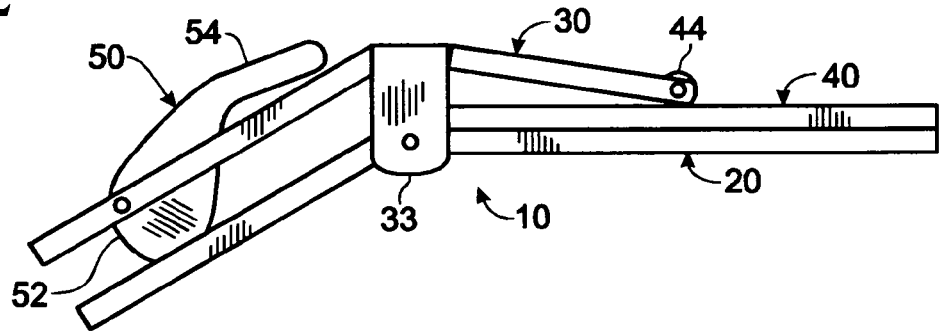
FIG. 2 is right side elevational view of the dobro capo of the present invention, shown in its closed (string clamping) position.
Figure 6:
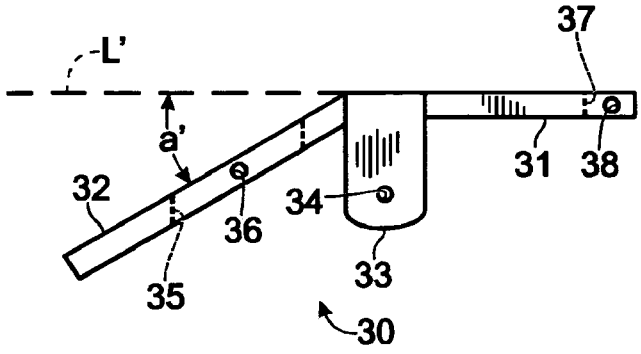
FIG. 6 is a right side elevational view of the upper curved bar member of the dobro capo.
Figure 7:
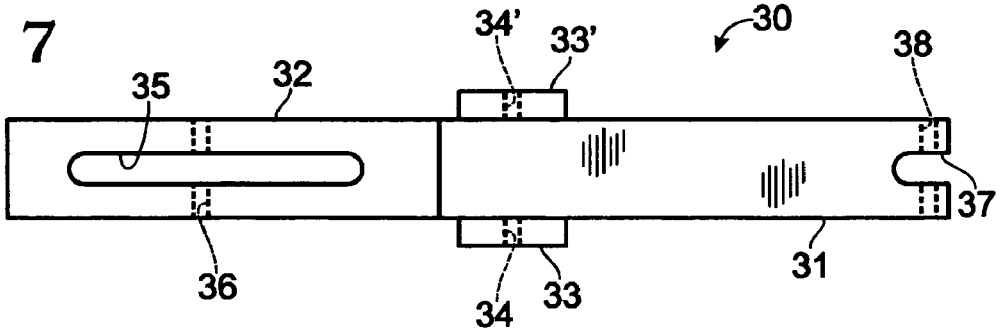
FIG. 7 is a top plan view of the upper curved bar member of the dobro capo.
Figure 8:
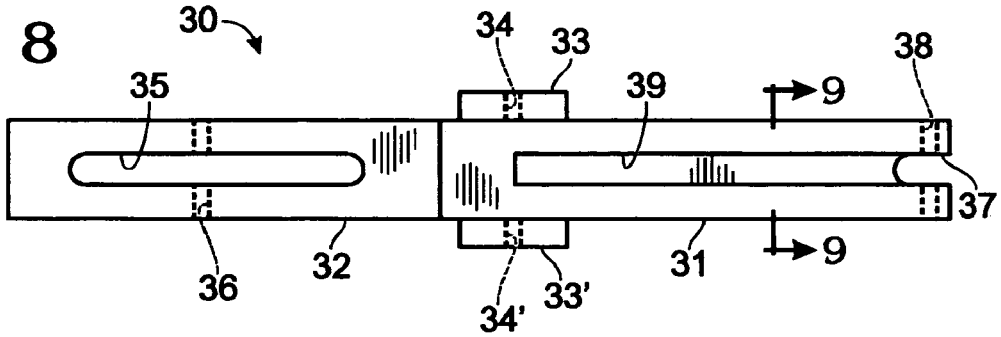
FIG. 8 is a bottom plan view of the upper curved bar member of the dobro capo.
Figure 9:
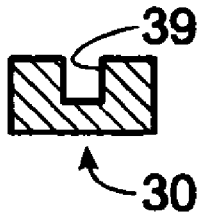
FIG. 9 is a front elevational view of the upper curved bar member of the dobro capo, taken along line 9—9 of FIG. 8.
Figure 10:
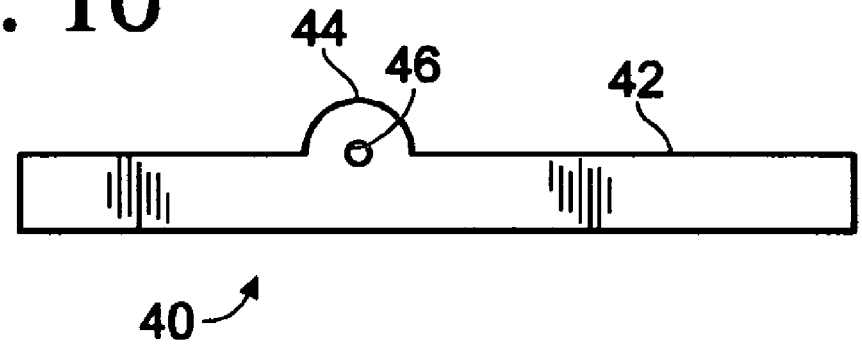
FIG. 10 is a right side elevational view of the pivoting string hold down bar of the dobro capo.
Figure 11:
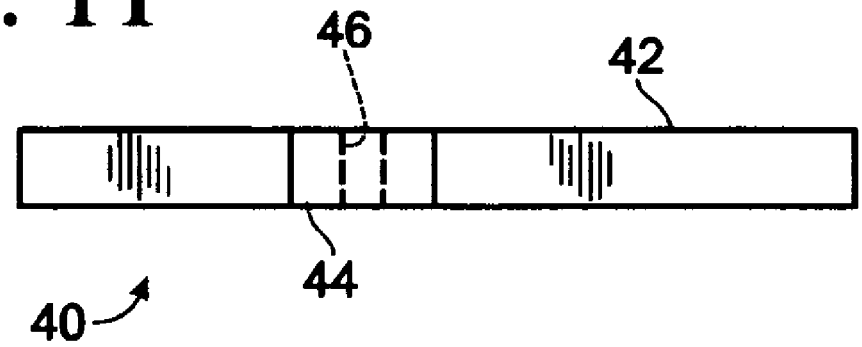
FIG. 11 is a top plan view of the pivoting string hold down bar of the dobro capo.

Upper curved bar member 30 includes a horizontal arm portion 31 and a downwardly curved arm portion 32 that meet at a juncture. Downwardly curved arm portion 32 is at an angle "a'" (FIG. 6) of between about 25 degrees and about 35 degrees, preferably about 30 degrees, to the horizontal line "L'" extended from horizontal arm portion 31. Angle "a" is preferably greater than angle "a'", as best seen in FIGS. 1 and 2.

A pair of right and left pivot ears 33 and 33' extend downwardly from the horizontal arm portion 31 of upper curved bar member 30 at a location adjacent the juncture of horizontal arm portion 31 and downwardly curved arm portion 32. Pivot ears 33 and 33' have pivot rod openings 34 and 34' extending therethrough.

A slot 35 is formed in downwardly curved arm portion 32, and extends longitudinally along the mid-portion thereof A pivot pin opening 36 extends through the walls of the slot 35 at a location between the mid-portion of slot 35 and its outer end.

A recess 37 extends a short distance inwardly from the outer end of horizontal arm portion 31, along its longitudinal axis. A pivot pin opening 38 extends through the walls of recess 37.

A channel 39 is formed in the lower, underside of horizontal arm portion 31. Channel 39 is located in the mid-portion thereof, and extends longitudinally rearwardly from a position adjacent recess 37 to an inner end located adjacent the juncture of horizontal arm portion 31 and downwardly curved arm portion 32.

String hold down bar 40 includes a main bar body 42 that is generally rectangular in cross-section and a pivot ear 44 extending from the upper surface thereof. Pivot ear 44 has a pivot pin opening 46 extending therethrough.

Pivot ear 44 of string hold down bar 40 is inserted into recess 37 of the horizontal arm portion 31 of upper curved bar member 30, and a pivot pin inserted through pivot pin openings 38 and 46.

Cam locking lever 50 includes a main body portion 52 and a finger actuation lever portion 54. The main body portion 52 of cam locking lever 50 is inserted into slot 35 of upper curved bar member 30, and a pivot pin inserted through pivot pin opening 36 of upper curved bar member 30 and through a pivot pin opening (not shown) in main body portion 52 of cam locking lever 50.

Lower curved bar member 20 is inserted into the space between pivot ears 33 and 33' of upper curved bar member 30 with the pivot pin openings 33 and 33' of pivot ears 33 and 33' in alignment with pivot pin opening 26 in lower curved bar member 20.

Pivot pins are inserted through pivot pin openings 26, 34 and 34', and 36. Preferably the pivot pins are removable to provide for easy disassembly and cleaning of the capo 10. They can, for example, have an "L" shape.

In operation, the user rotates cam locking lever 50 backwardly by pressing against lever portion 54 with his or her thumb, and pushing downwardly curved arm portion 32 of upper curved bar member 30 downwardly into contact with downwardly curved arm portion 24 of lower curved bar member 20, to thereby cause string hold down bar 40 to be raised, as shown in FIG. 1. The horizontal arm portion 22 of lower curved bar member 20 is then placed on the fretboard of a dobro at the desired location, with the string hold down bar 40 positioned above the strings. The user then rotates cam locking lever 50 upwardly to its locked position shown in FIG. 2 by pressing against lever portion 54 with his or her thumb to thereby clamp the strings between the lower surface of the string hold down bar 40 and the upper surface of the horizontal arm portion 22 of lower curved bar member 20. In its locked clamping position shown in FIG. 2, the upper part of string hold down bar 40 rests within channel 39 of the horizontal arm portion 31 of upper curved bar member 30.

The user can repeat this operation to move the capo to a new location, which operation can be easily accomplished by the use of a single hand.

While the capo of the present invention has been described as being used with a dobro, it can be used with any similar stringed instrument where capos are used.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A capo for use with a dobro or similar stringed instrument comprising:

a lower curved bar member including a horizontal arm portion and a downwardly curved arm portion meeting at a juncture;

an upper curved bar member including a horizontal arm portion and a downwardly curved arm portion meeting at a juncture, a cam locking lever pivotally mounted on said downwardly curved arm portion, and a string hold down bar pivotally mounted on said horizontal arm portion;

said lower curved bar member being pivotally mounted to said upper curved bar member.

2. The capo of claim 1 wherein said downwardly curved arm portion of said upper curved bar has a slot adapted to receive said cam locking lever and means for pivotally mounting said cam locking lever within said slot.

3. The capo of claim 1 wherein first and second pivot ears are attached to each side of said horizontal arm portion of said upper curved bar member and adapted to receive and pivotally mount said lower curved member.

4. The capo of claim 1 wherein said string hold down bar is pivotally mounted in a recess located on the end of said horizontal arm portion of said upper curved bar member.

5. The capo of claim 1 wherein said downwardly curved arms of said upper and lower curved bar members curve downwardly at an angle of between about 30 degrees and about 40 degrees to the horizontal.

6. A capo for use with a dobro or similar stringed instrument comprising:

a lower curved bar member including a horizontal arm portion and a downwardly curved arm portion meeting at a juncture;

an upper curved bar member including a horizontal arm portion and a downwardly curved arm portion meeting at a juncture, a slot extending longitudinally in the mid-portion of said downwardly curved arm portion, a cam locking lever pivotally mounted within said slot, first and second pivot ears located on each side of said horizontal arm portion adjacent the juncture of said horizontal and downwardly curved arm portions, a recess located in the mid-portion of the outer end of said horizontal arm portion, and a string hold down bar pivotally mounted within said recess;

said lower curved bar member being pivotally mounted between said first and second pivot ears of said upper curved bar member.

7. The capo of claim 6 wherein said downwardly curved arms of said upper and lower curved bar members curve downwardly at an angle of between about 30 degrees and about 40 degrees to the horizontal.

* * * * *